US010562164B2

(12) United States Patent
Voulkidis et al.

(10) Patent No.: US 10,562,164 B2
(45) Date of Patent: Feb. 18, 2020

(54) DRIVE-IN DEVICE

(71) Applicant: Hilti Aktiengesellschaft, Schaan (LI)

(72) Inventors: Orestis Voulkidis, Kisslegg (DE); Matthias Blessing, Frastanz (AT)

(73) Assignee: HILTI AKTIENGESELLSCHAFT, Schaan (LI)

( * ) Notice: Subject to any disclaimer, the term of this patent is extended or adjusted under 35 U.S.C. 154(b) by 474 days.

(21) Appl. No.: 15/104,368

(22) PCT Filed: Dec. 16, 2014

(86) PCT No.: PCT/EP2014/077913
§ 371 (c)(1),
(2) Date: Jun. 14, 2016

(87) PCT Pub. No.: WO2015/091449
PCT Pub. Date: Jun. 25, 2015

(65) Prior Publication Data

US 2016/0311099 A1 Oct. 27, 2016

(30) Foreign Application Priority Data

Dec. 19, 2013 (EP) ..... 13198436

(51) Int. Cl.
*B25C 1/14* (2006.01)

(52) U.S. Cl.
CPC ..... *B25C 1/143* (2013.01)

(58) Field of Classification Search
CPC .... H04N 7/26; B25C 1/08; B25C 1/10; B25C 1/18; B25C 1/143; B25D 9/11
(Continued)

(56) References Cited

U.S. PATENT DOCUMENTS 3,204,400 A * 9/1965 Kvavle ..... B25C 1/14 227/10
3,348,751 A * 10/1967 Henning ..... B25C 1/143 227/10

(Continued)

FOREIGN PATENT DOCUMENTS

CN 1099687 A 3/1995
CN 1509847 A 7/2004

(Continued)

OTHER PUBLICATIONS

International Bureau, International Search Report in International Patent Application No. PCT/EP2014/077913, dated Mar. 25, 2015.

(Continued)

*Primary Examiner* — Alexander M Valvis
*Assistant Examiner* — Daniel Jeremy Leeds
(74) *Attorney, Agent, or Firm* — Leydig Voit & Mayer, Ltd.

(57) ABSTRACT

The invention relates to a drive-in device, comprising a hand-held housing having a piston element received therein for transmitting energy onto a fastening element to be driven in, an exchangeable propellant charge, a combustion chamber, arranged between the propellant charge and the piston element and extending about a center axis (A), and a control element by means of which a starting position of the piston element can be set to be modified in order to modify the energy transmitted by the propellant charge onto the piston element, the control element having an operating element that can be pivoted about the center axis (A).

19 Claims, 4 Drawing Sheets

Figure 1:
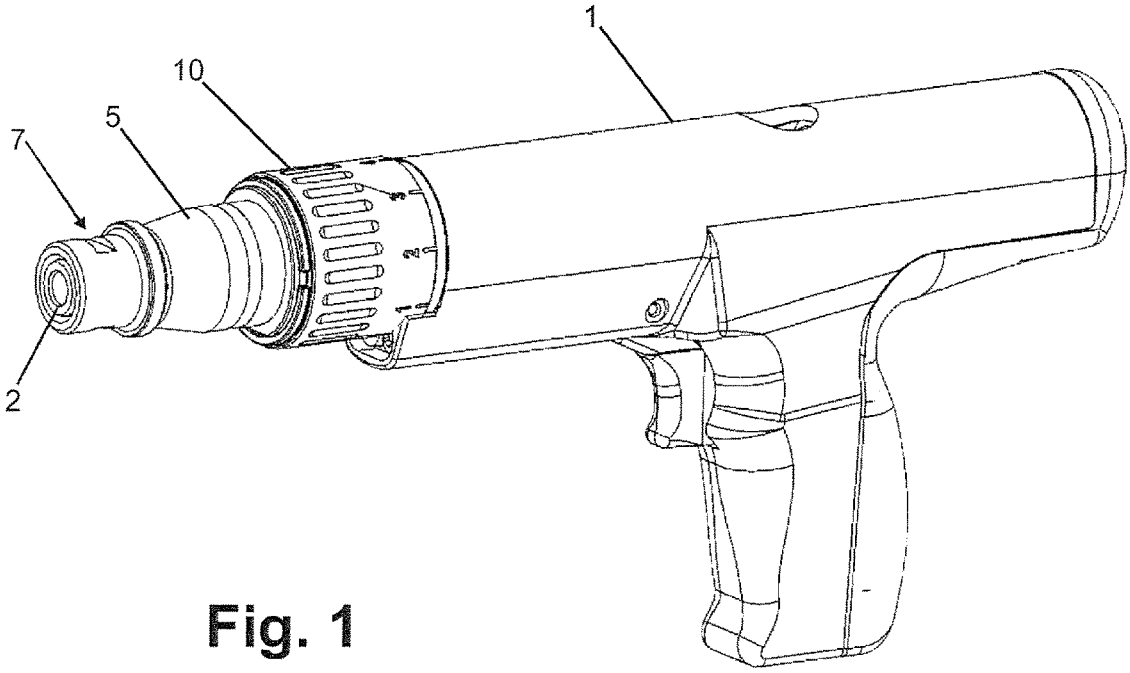

(58) Field of Classification Search
USPC ..... 173/90; 227/9, 10
See application file for complete search history.

(56) References Cited

U.S. PATENT DOCUMENTS 3,370,770 A * 2/1968 Henning ..... B25C 1/10 102/531
3,575,332 A * 4/1971 Brunelle ..... B25C 1/143 227/10
3,652,003 A * 3/1972 Leonardo ..... B25C 1/105 227/10
3,659,768 A * 5/1972 Brunelle ..... B25C 1/082 227/10
3,690,536 A * 9/1972 Bakoledis ..... B25C 1/14 227/10
3,746,235 A * 7/1973 Crabtree, Jr. ..... B25C 1/14 227/10
3,899,113 A * 8/1975 Brack ..... B25C 1/082 227/10
3,910,477 A * 10/1975 Kavan ..... B25C 1/14 227/10
3,918,619 A * 11/1975 Termet ..... B25C 1/143 227/10
3,973,708 A * 8/1976 Scotoni ..... B25C 1/082 227/10
4,068,790 A * 1/1978 Osterle ..... B25C 1/18 227/8
4,078,710 A * 3/1978 Galluzzi ..... B25C 1/087 227/10
4,153,192 A * 5/1979 Jochum ..... B25C 1/14 227/10
4,218,005 A * 8/1980 Harris ..... B25C 1/16 227/10
4,382,533 A * 5/1983 Buechel ..... B25C 1/082 227/10
4,493,376 A * 1/1985 Kopf ..... B25D 9/11 173/210
4,577,793 A * 3/1986 Jochum ..... B25C 1/14 227/10
4,598,851 A * 7/1986 Kopf ..... B25C 1/008 227/10
4,708,061 A * 11/1987 Buechel ..... B25C 1/143 102/331
4,821,938 A * 4/1989 Haytayan ..... B25C 1/184 227/10
4,830,254 A * 5/1989 Hsu ..... B25C 1/082 227/10
4,877,171 A * 10/1989 Almeras ..... B25C 1/143 227/10
4,883,212 A * 11/1989 Philipp ..... B25C 1/18 227/9
5,269,450 A * 12/1993 Popovich ..... B25C 1/146 173/211
5,273,198 A * 12/1993 Popovich ..... B25C 1/143 227/10
5,394,702 A 3/1995 Jochum
5,425,488 A * 6/1995 Thompson ..... B25C 1/14 227/10
5,653,370 A * 8/1997 Bereiter ..... B25C 1/123 173/162.2
5,664,361 A * 9/1997 Frommelt ..... B25C 1/14 42/106
5,699,948 A * 12/1997 Lee ..... B25C 1/14 227/10
5,732,869 A * 3/1998 Hirtl ..... B25C 1/143 227/10
5,799,855 A * 9/1998 Veoukas ..... B25C 1/188 227/10
6,015,078 A * 1/2000 Almeras ..... B25C 1/143 227/10
6,032,846 A * 3/2000 Clark ..... B25C 1/14 227/10
6,679,410 B2 * 1/2004 Wursch ..... B25C 1/143 227/10
6,824,034 B2 * 11/2004 Sprenger ..... B25C 1/14 192/129 R
7,308,997 B2 * 12/2007 Neumann ..... B25C 1/082 123/23
8,087,561 B2 * 1/2012 Lee ..... B25C 1/143 227/10
8,256,406 B1 * 9/2012 Kirkpatrick ..... F41B 11/723 102/440
9,272,408 B2 * 3/2016 Koch ..... B25D 17/24
2003/0015088 A1 * 1/2003 Wursch ..... B25C 1/143 89/1.14
2003/0094167 A1 * 5/2003 Nibecker, Jr. ..... F41B 11/683 124/64
2004/0187810 A1 9/2004 Gschwend et al.
2007/0000458 A1 * 1/2007 Neumann ..... B25C 1/082 123/46 H
2011/0017483 A1 * 1/2011 Baumann ..... B25D 11/062 173/162.2
2012/0037683 A1 * 2/2012 Lee ..... B25C 1/143 227/10
2013/0082083 A1 * 4/2013 Largo ..... B25C 1/041 227/8
2013/0270319 A1 * 10/2013 Gauger ..... B25C 1/08 227/2
2014/0054350 A1 * 2/2014 Pedicini ..... B25C 5/15 227/8
2016/0207186 A1 * 7/2016 Bruggmueller ..... B25C 1/06
2016/0214249 A1 * 7/2016 Bruggmueller ..... B25C 1/047
2016/0303725 A1 * 10/2016 Goepfert ..... B25C 1/14
2016/0311096 A1 * 10/2016 Blessing ..... B25C 1/143
2016/0311097 A1 * 10/2016 Blessing ..... B25C 1/143
2016/0339574 A1 * 11/2016 Fielitz ..... B25C 1/143
2017/0100830 A1 * 4/2017 Blessing ..... B25C 1/143
2017/0341210 A1 * 11/2017 Stauss-Reiner ..... B25C 1/008
2017/0348840 A1 * 12/2017 Woerner ..... B25C 1/008

FOREIGN PATENT DOCUMENTS

DE 24 47 767 A1 4/1976
DE 26 28 814 A1 1/1977
DE 25 48 014 A1 4/1977
DE 4032204 A1 * 4/1992 ..... B25C 1/08
GB 1 475 850 A 6/1977
GB 1 540 247 A 2/1979
GB 1 553 997 A 10/1979
RU 2037394 C1 6/1995
RU 21038 U1 12/2001

OTHER PUBLICATIONS

European Patent Office, European Search Report in European Patent Application No. 13198436.1, dated Jul. 3, 2014.
DX 36 Operating Instructions, Hilti Aktiengesellschaft (2013), 73 pages; printed from internet Jun. 14, 2016.
Russian Patent Office, Office Action and Search Report in counterpart Russian Application No. 2016129209/02(045437), dated Oct. 31, 2017.

* cited by examiner

DRIVE-IN DEVICE

CROSS-REFERENCE TO RELATED APPLICATIONS

This patent application is the U.S. National Stage of International Patent Application No. PCT/EP2014/077913, filed Dec. 16, 2014, which claims the benefit of European Patent Application No. 13198436.1, filed Dec. 19, 2013, which are each incorporated by reference.

The invention relates to a drive-in device according to the preamble of claim 1.

BACKGROUND OF THE INVENTION

Hand-operated drive-in devices having propellant charges are known from the prior art, in which the resulting combustion gases expand in a combustion chamber following ignition of a pyrotechnic charge. A piston is thereby accelerated as an energy transmission means and drives a fastening element into a workpiece.

A known pyrotechnic drive-in device is distributed by the Hilti Corporation, Schaan, Liechtensten under the name DX 36. In this device the drive-in energy of a piston can be reduced as needed through controlled setting of the starting position of the piston in a combustion chamber. For this purpose, a handwheel is provided on the device, the handwheel being displaced laterally to a center axis of the piston in a rear section of the device relative to the drive-in direction.

The device DX 36 also constitutes a type of drive-in devices not having automatic piston return. In the DX 36, the piston is brought into a starting position through a manual repeater motion following a drive-in action. For this purpose, a piston guide is, in a first stage of the repeater motion, shifted forward together with the piston in the drive-in direction until a defined stop arrests this movement. In a second stage of the repeater motion, the piston guide is shifted rearward in the opposite direction until the piston guide reaches a defined rear stop.

In the device DX 36 the piston is, through a first stage of the repeater motion, brought to a rear position in the piston guide, which corresponds to a starting position with maximum drive-in energy. In the course of the second stage of the repeater motion the piston element can be shifted as needed by means of an adjustable stop to a preset starting position relative to the piston guide.

The invention seeks to solve the problem of providing a drive-in device that allows a drive-in energy to be set in a simple manner for a given propellant charge.

BRIEF SUMMARY OF THE INVENTION

According to the invention, this problem is solved for a drive-in device of the type initially specified through the characterizing features of claim 1. The operating element being able to pivot about the center axis facilitates simple adjustment and at the same time effective visual control of the value set. Such an arrangement additionally allows simple adjustment even under unfavorable conditions, such as when wearing gloves.

A center axis as defined in the invention is an axis that is at least parallel to the motion of the fastening element and runs through the center of the combustion chamber. The center axis preferably runs both through the center of the combustion chamber and a center of the fastening element.

The operating element can be any suitable means for manual adjustment, such as a rotatable sleeve, a pivotable knob or similar element.

Pivoting the operating element about the center axis is understood to mean moving the operating element from a previous position so that it is oriented essentially perpendicular to the axis. In this process a line of motion or trajectory of the operating element has a curvature radius that is preferably not smaller than the distance between the operating element and the center axis. It is preferable, but not required, that the pivoting is a rotation about the center axis.

In the context of the invention, drive-in energy is understood to mean the kinetic energy of a given fastening means for a given propellant charge. When these boundary conditions are present, the control element allows the resulting drive-in energy of the fastening means to be adjustably changed.

In the context of the invention, a piston element is any means that is acted upon by kinetic energy through the ignition of the charge, the kinetic energy ultimately being transmitted to the fastening means. The piston element is frequently realized particularly as a cylindrical piston. Recesses or other structures can be provided in the base of the piston that further promote a swirling and even expansion of the combustion gases.

In the context of the invention, a fastening element generally is generally understood to mean any drivable anchoring such as, for example, nails, pins or screws.

In a preferred embodiment of the invention, the operating element is coupled via a mechanical forced control to a stop element that can be adjusted in the direction of the central axis. This enables an ergonomically preferred adjustment of the operating element, in particular having large adjustment ranges, to be implemented in a simple manner in a corresponding axial adjustment of the stop element. In this context, the axial adjustment of the stop element can provide an adjustable stop of the piston element or a guidance of the piston element depending on mechanical design, thereby allowing overall a preset position of the piston element to be achieved. For reliable and simple realization, such a forced control can preferably comprise a slide track and slider running in the slide track.

In a generally preferred embodiment of the invention, it is provided that the piston element is movably accommodated in a piston guide preferably comprising the combustion chamber, the piston guide being accommodated axially displaceable in relation to the hand-held housing of the drive-in device. Such construction allows, for one, a repeater motion for manual piston element return. The repeater motion sequence performed by the operator can occur, for example, in the same manner as described for the Hilti Corporation DX 36 drive-in device initially described.

In a preferred refinement, the distance between a first stop acting on the piston guide and a second stop acting on the piston element can be adjusted by means of the control element. This positioning the stop elements in relation to one another allows a defined presetting of the starting position of the piston member to be achieved in a simple manner through the resetting sequence of the piston element. In an especially preferred embodiment of the invention it is provided that the two stop elements act on the piston element and the piston guide in the same direction. This allows the drive-in device according to the invention to be mechanically realized in a simple and reliable manner.

In a preferred detail design, the starting position of the piston member is set relative to the piston guide in the course of extending the piston guide forward in the direction of the drive-in device. In a subsequent, second stage of a repeater motion the piston guide is then brought with the already defined preset piston member into a rear starting position for the drive-in action. This functional sequence in the course of the repeater motion can be combined with an inventive design of the operating element in an especially simple manner.

It is generally advantageous if the operating element is realized as an annular sleeve, the sleeve surrounding the center axis. For adjusting the drive-in energy, the sleeve can be rotated to multiple different positions, with at least two different positions corresponding to two different drive-in energies. For advantageous operation, the sleeve can be held in at least a defined position by means of a catch member. Such defined positions can be a servicing setting or also a defined setting for changing drive-in energy.

An operating element according to the invention and in particular a sleeve as described above can be arranged for optimizing the ergonomics of the device in a front area forward a device handle. The arrangement and design of the operating element can advantageously be analogous to that of known operating elements of hand-held drills and/or battery-operated screwdrivers. The operating elements of such devices accordingly serve other purposes such as, for example, adjusting torque or switching from screwing action to hammering action in the case of a hammer-drill.

In a generally advantageous refinement of the invention, the operating element can also be used for a function in addition to energy adjustment. In a preferred exemplary embodiment, removal of the piston member can be reversibly blocked by the operating element. Pyrotechnically driven drive-in devices must be regularly disassembled for cleaning and servicing purpose, with the piston element usually being removed from the device to allow cleaning of the piston element and combustion chamber.

In a preferred detail design, a locking element locking the piston element can be unlocked in only one of several operating element settings. Unlocking the locking element allows the locking element to be released, the device to be disassembled and the piston element to be removed.

In a simple execution, the operating element has a recess, the locking element being movable in radial direction when covered by the recess. Moving the locking element radially allows removal of the piston element and/or the guide thereof.

In particular, the locking element in locked position can at the same time function as a stop for the piston element or the piston guide, the in particular manual resetting of the piston member being achieved with the assistance of the stop.

Additional features and advantages of the invention can be found in the exemplary embodiment as well as in the dependent claims. A preferred exemplary embodiment of the invention is described below and explained in greater detail using the attached drawings.

BRIEF DESCRIPTION OF THE SEVERAL VIEWS OF THE DRAWING(S)

Figure 2:
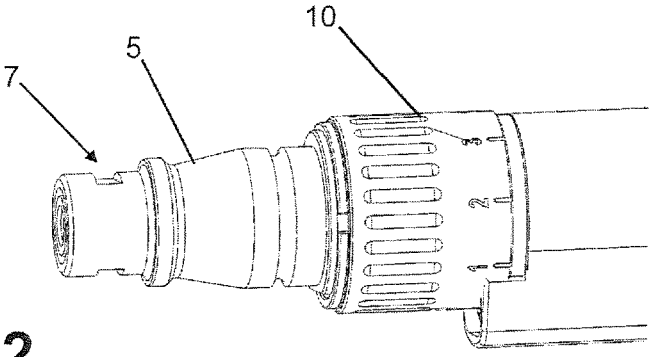

FIG. 1 Perspective full view of a drive-in device according to the invention FIG. 2 Perspective detailed view of a drive-in device shown in FIG. 1

Figure 3:
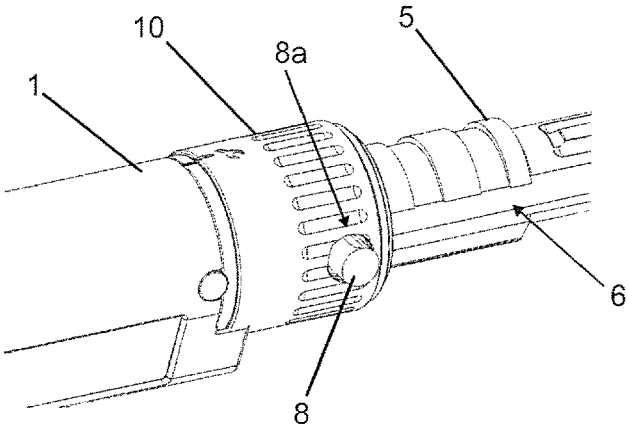
Figure 4:
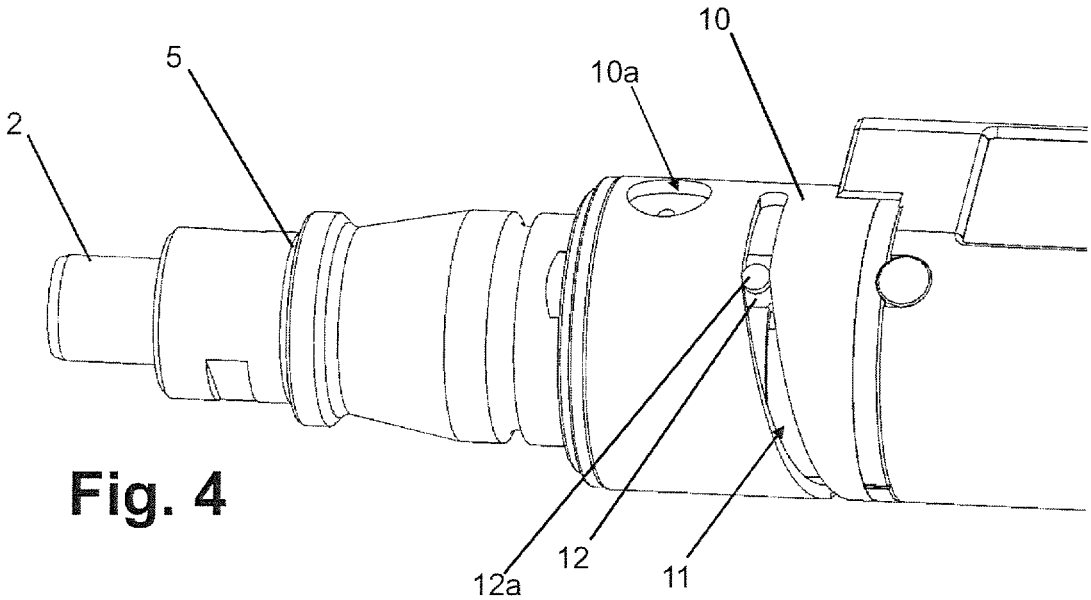
Figure 5:
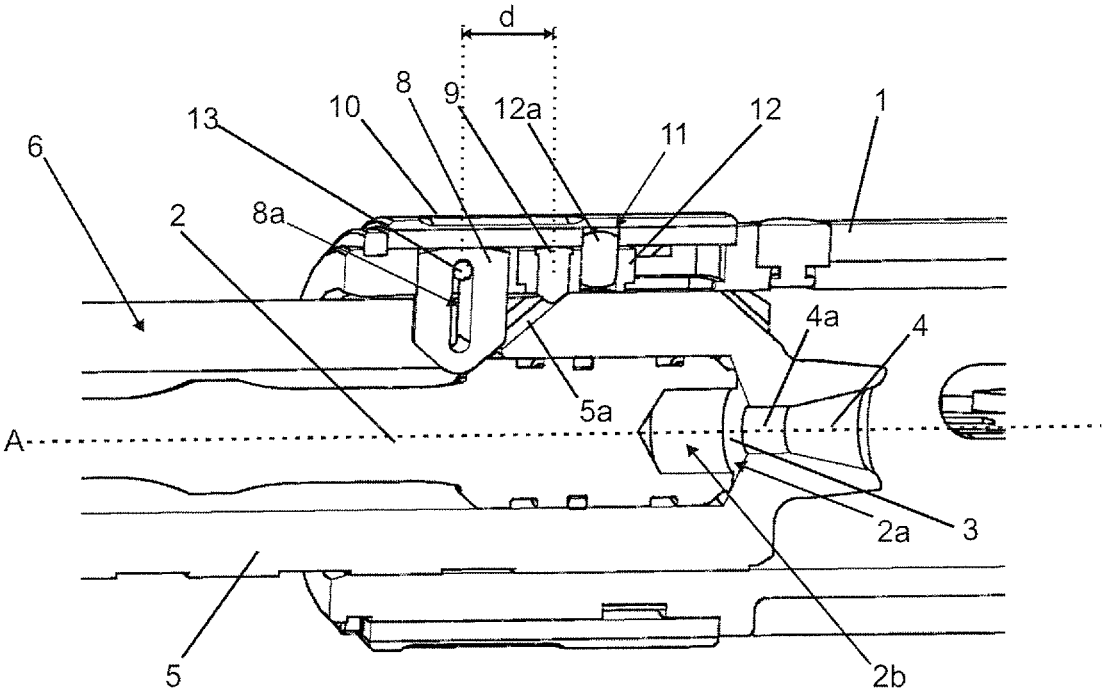
Figure 6:
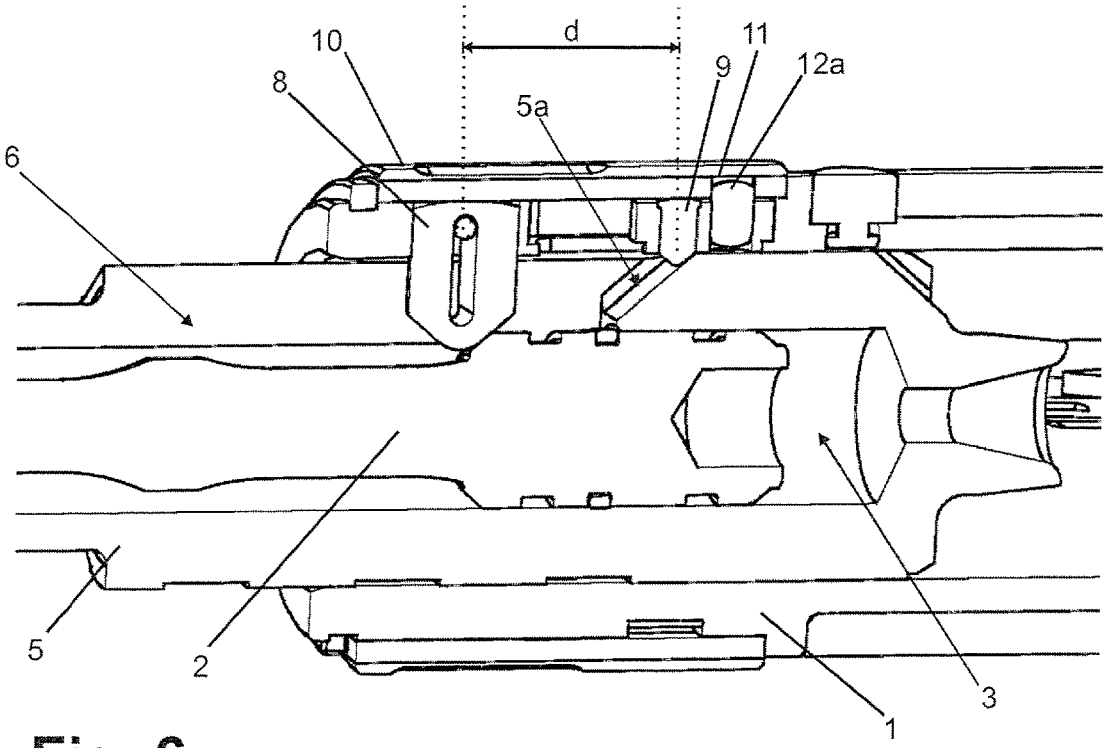
Figure 7:
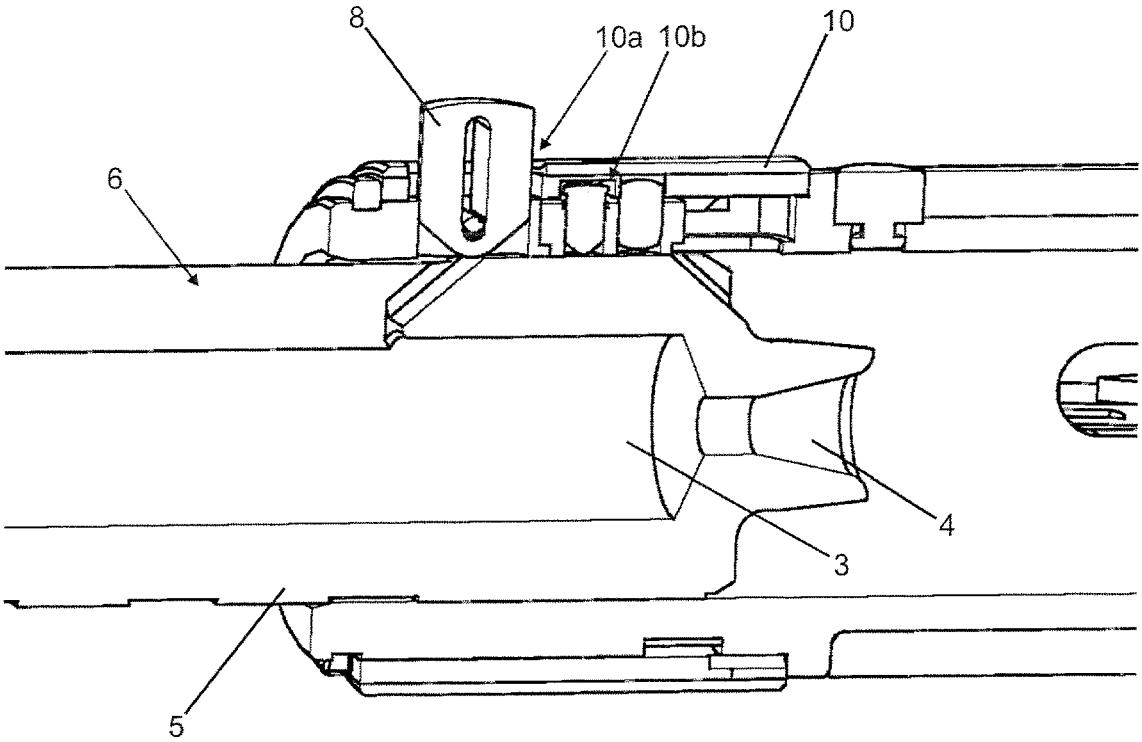
Figure 8:
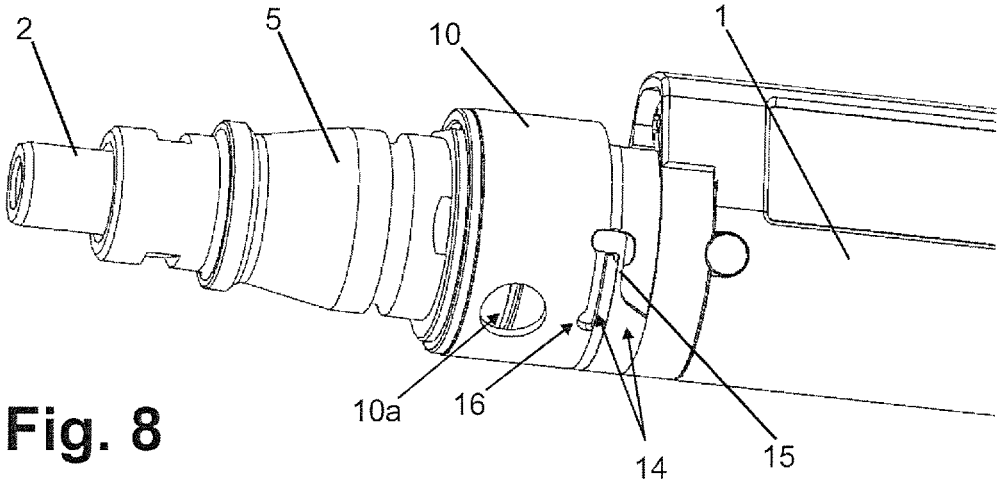
Figure 9:
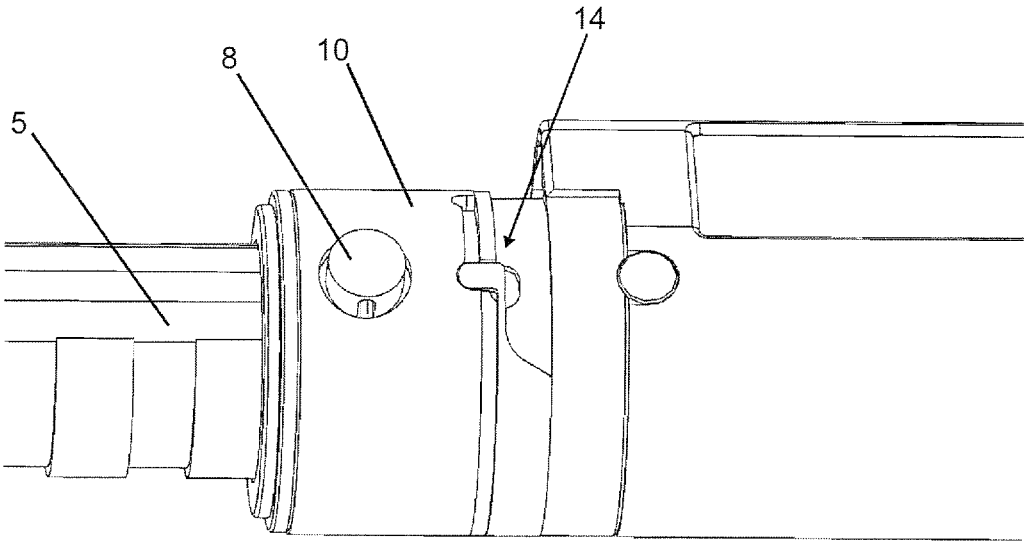

FIG. 3 A further perspective detailed view of a drive-in device shown in FIG. 1 with an operating element in a servicing position FIG. 4 A different perspective detailed view of a drive-in device shown in FIG. 1 with an operating element in maximum drive-in energy setting, an external covering of the operating element having been omitted FIG. 5 A partial cutaway view through the drive-in-device shown in FIG. 1 in maximum drive-in energy setting FIG. 6 The cutaway view from FIG. 5 at minimum drive-in energy setting FIG. 7 The cutaway view from FIG. 5 with the operating element in a servicing position with a released locking element and removed piston element FIG. 8 A perspective detailed view of a further exemplary embodiment of the invention FIG. 9 The exemplary embodiment from FIG. 8 with an operating element in a servicing position

DETAILED DESCRIPTION OF THE INVENTION

A drive-in device according to the invention comprises a hand-held housing 1 in which a piston element in the form a piston 2 is accommodated. A surface 2*a* of the piston 2 defines a combustion chamber 3 in which the combustion gases of a pyrotechnic charge expand for the purpose of accelerating the piston 2.

The piston 2 acted on in this manner by kinetic energy strikes a tappet at the end of a fastening element (not shown), which is thereby driven into a workpiece.

In this example, the charge is accommodated in a sheet metal cartridge. The cartridge has a piercing fuse and, prior to ignition, is inserted into a cartridge holder 4 via an appropriate loading mechanism. The cartridge and the cartridge holder 4 are realized rotationally symmetrically about a center axis A. In the present examples, the center axis A is at the same time a center axis of the combustion chamber 3 and the piston element 2.

The combustion chamber 3 is arranged between a circular opening 4*a* of the cartridge holder 4 and the surface 2*a* of the piston 2. In this case a depression 2*b* is realized in the piston 2, which contributes to better swirling of the combustion gases and constitutes part of the defining of the combustion chamber 3.

The combustion chamber 3 with the cartridge holder 4 is part of a piston guide 5. The piston guide 5 is a component that can be displaced linearly along the axis in the housing 1 of the drive-in device. The piston element 2 for its part can be displaced linearly along the central axis A in the piston guide 5.

In its front area, the piston guide is shaped essentially as a hollow cylindrical element, a slit 6 being provided in the wall of the piston guide 5 starting from the end of the combustion chamber 3 area.

A front end of the piston guide 5 is releasably attached to a receiver for the fastening means (not shown). This receiver can be realized as a different module according to use. The receiver can be connected to the piston guide via a clamp, which engages a recess 7 at a front end of the piston guide 5.

A first stop element 8 protrudes into the slit 6 in radial direction. The stop element 8 functions, on one hand, as a front stop for the piston element 2 in the course of manual piston resetting or a two-stage repeater motion. On the other hand, the stop element 8 functions as a locking element, the removal of the piston element 2 and piston guide 5 being prevented when the locking element is in closed state.

A second stop element 9 protrudes likewise in radial direction from the housing 1 inward, a beveling 5*a* acting together with the second stop element 9 as a stop on the piston guide. The second stop element 9 also functions at the same time as a releasable locking element, which, in closed state, prevents the piston guide 5 from being removed from the housing 1.

A manual piston return design as presented here makes it possible for stop elements to have a dual function, allowing them to also serve as releasable locking elements for device disassembly. In other drive-in device designs these functions can also each be provided by different components.

The distance d between the stop elements 8,9 can be adjustably changed by means of an operating element 10, where the starting position of the piston element 2 relative to the piston guide 5 or combustion chamber 3 can be changed by adjusting the size of the distance d.

Furthermore, when the operating element 10 is in a servicing position, the stop elements 8,9 can be released for a radial movement outward and thus an unlocking, whereas they are locked in radial direction in other positions of the operating element 10. For this purpose, the operating element 10 also has recesses 10*a*, 10*b* in which the locking elements or stop elements 8,9 engage when the operating element 10 is in the appropriate position. This can be illustrated by comparing the servicing position in FIG. 7 with a normal operating position in FIG. 5 or FIG. 6.

The operating element 10 is realized in this case as a rotatable, annular sleeve, which is arranged in essence concentrically around the center axis A in a forward area of the housing 1 of the drive-in device.

A slide track 11 is molded in the sleeve 10. A slider 12 is mounted such that it is movable only in axial direction and engages the slide track 11 from below by means of a stud 12*a*. Pivoting or, in this case, rotating the sleeve 10 about the center axis A changes the axial position of the slider in a positively driven manner.

The second stop element 9 is connected to the slider 12 and is shifted correspondingly with the slider in axial direction. The slider track 11 and the slider 12 thus collectively constitute a mechanical forced control for axial displacement of the stop element 9.

The stop elements 8,9 collectively form with the operating element 10 and the forced control 11, 12 a control element for changing the starting position of the piston element 2, thereby facilitating an adjustable reduction of the drive-in energy of the piston element compared to a maximal rear starting position of the piston element in the combustion chamber 3. This adjustment proceeds as follows:

Following an energy action, the piston element is located in a partly undefined, yet primarily forward-shifted position. The piston guide 5 is in a maximally rearward-shifted position in the drive-in device. In this document, the terms "forward" and "rearward" are always in relation to the to the drive-in direction.

Thereafter, in preparation for the next energy action, the desired drive-in energy is adjusted as energy level labeled on the operating element by rotating the sleeve 10. This leads to a selected axial positioning of the second stop element 9 by means of the forced control described above. In this exemplary embodiment, the first stop element 8 cannot be adjusted in axial direction.

Subsequently, the piston guide is extended forward out of the housing as the first stage of a repeater motion. In this process the piston element 2 is moved along until it strikes the first stop element 8. From this point in time, the piston guide is also moved relative to the piston element 2 until it strikes the second stop element 9 in the same stop direction. The setting of distance d carried out prior now provides a defined prescribed (or also the maximum pushed back) starting position of the piston element 2 in the combustion chamber 3.

The piston guide 5 is then inserted back into the device in the opposite direction until reaching a starting position for the next drive-in action. During this second stage of the repeater motion, the piston element is no longer moved relative to the piston guide. By means of a further, in principle already known, mechanism, a propellant charge is introduced into the cartridge holder 4 and the device is ready for the next drive-in action.

Irrespective of this defining of the starting position of the piston element, a further function can additionally be provided by the operating element 10. In this case it involves the servicing position of the sleeve 10 shown in FIG. 3 and FIG. 7. In this servicing position, piston element 2 and piston guide 5 can be removed from the housing 1 for checking, replacing or cleaning parts.

For this purpose, the sleeve-shaped operating element 10 has the first recess 10*a*, which is shaped as a through hole and the second recess 10*b*, which is realized as a hollow space. A ramp can be attached laterally to the hollow space, thereby allowing the second stop element 9 to be pressed radially inward again following assembly.

In the corresponding servicing setting, the stop elements or locking elements 8, 9 are no longer prevented from moving radially, but rather can be pressed radially outward through bevelings in the course of piston element 2 and piston guide 5 being pulled out (see FIG. 3, FIG. 7). The locking elements 8, 9 are unlocked in these positions.

The second locking element 9 is further secured from falling out by the sleeve 10. The first locking element 9 exerts a greater stroke in radial direction and is secured by an open spring washer 13 which clamps down on a slit 8*a* in the locking element 8.

In the second exemplary embodiment shown in FIG. 8, provided on the operating element 10 realized as a sleeve is a locking element 14 by means of which the sleeve 10 is held in a locking manner in various defined rotational positions. Overcoming the locking force allows the sleeve to be adjusted out of these positions.

As a catch mechanism, the locking member has a flexible tongue 15, which engages, by means of a projection, a marginal detent plate 16 on the sleeve 10. The spring force of the flexible tongue 15 acts in axial direction in this case.

In another embodiment not illustrated, a radially acting catch spring can also engage a radially oriented detent plate of the sleeve 10. Such catch mechanisms are known, for example, in sleeves for adjusting torque on drills.

The variant shown in FIG. 8 and FIG. 9 constitutes a simplified version that envisions no adjustment of drive-in energy. The sleeve therefore has only two catch positions, namely a servicing position (FIG. 9) and an operating position (FIG. 8). In the servicing position as shown in FIG. 9, the released locking element 8 is shoved radially outward analogous to the first example in FIG. 3. This occurs in the course of piston element 2 and piston guide 5 being removed through the interaction of the components with the locking element 8 via the particular beveled surfaces 5*a*.

In an embodiment according to the invention, provided beneath the rotatable sleeve 10 as operating element as in the first exemplary embodiment is a slide track 11 and a slider 12, by means of which the second stop element 9 is adjusted in axial direction. Accordingly, a variant according to the invention expediently has further catch positions, which can correspond to, in particular, discrete, pre-selectable energy settings.

The invention claimed is:

1. A drive-in device comprising a hand-held housing with a piston element received therein for transmitting energy to a fastening element to be driven in, the piston element having a starting position;

a propellant charge;

a combustion chamber arranged between the propellant charge and the piston element and extending about a center axis (A), and a control element for adjustably changing the starting position of the piston element for changing energy being transmitted by the propellant charge to the piston element, the the control element having an operating element that can pivot about the center axis (A), wherein pivoting the operating element changes the energy being transmitted by the propellant charge to the piston element, and removal of the piston element is reversibly blocked by the operating element, wherein the operating element is coupled via a mechanical forced control to a stop element adjustable in the direction of the center axis (A), wherein the control element comprises a slider track and a slider running in the slider track.

2. The drive-in device according to claim 1, wherein the piston element is movably accommodated in a piston guide such that it is axially displaceable in relation to the hand-held housing of the drive-in device.

3. The drive-in device according to claim 1, wherein the starting position of the piston element is set relative to the piston guide in the course extending the piston guide forward in a drive-in direction.

4. The drive-in device according to claim 1, wherein the operating element comprises an annular sleeve, the sleeve encircling the center axis (A).

5. The drive-in device of claim 1, comprising a locking element blocking the piston element, wherein the locking element can be unlocked only in one of multiple positions of the operating element.

6. The drive-in device of claim 5, wherein the operating element has a recess, the locking element being movable in radial direction when the locking element is covered by the recess.

7. A drive-in device comprising a hand-held housing with a piston element received therein for transmitting energy to a fastening element to be driven in, the piston element having a starting position;

a propellant charge;

a combustion chamber arranged between the propellant charge and the piston element and extending about a center axis (A), and a control element for adjustably changing the starting position of the piston element for changing energy being transmitted by the propellant charge to the piston element, the the control element having an operating element that can pivot about the center axis (A), wherein pivoting the operating element changes the energy being transmitted by the propellant charge to the piston element, and removal of the piston element is reversibly blocked by the operating element, wherein the piston element is movably accommodated in a piston guide such that it is axially displaceable in relation to the hand-held housing of the drive-in device, wherein a distance (d) between a first stop element acting on the piston guide and a second stop element acting on the piston element can be adjustably set through the control element.

8. The drive-in device as claimed in claim 7, wherein the first and second stop elements act on the piston element and on the piston guide in the same direction.

9. The drive-in device according to claim 7, wherein the starting position of the piston element is set relative to the piston guide in the course extending the piston guide forward in a drive-in direction.

10. The drive-in device according to claim 8, wherein the operating element comprises an annular sleeve, the sleeve encircling the center axis (A).

11. The drive-in device according to claim 7, wherein the operating element comprises an annular sleeve, the sleeve encircling the center axis (A).

12. The drive-in device of claim 7, comprising a locking element blocking the piston element, wherein the locking element can be unlocked only in one of multiple positions of the operating element.

13. The drive-in device of claim 12, wherein the operating element has a recess, the locking element being movable in radial direction when the locking element is covered by the recess.

14. A drive-in device comprising a hand-held housing with a piston element received therein for transmitting energy to a fastening element to be driven in, the piston element having a starting position;

a propellant charge;

a combustion chamber arranged between the propellant charge and the piston element and extending about a center axis (A), and a control element for adjustably changing the starting position of the piston element for changing energy being transmitted by the propellant charge to the piston element, the the control element having an operating element that can pivot about the center axis (A), wherein pivoting the operating element changes the energy being transmitted by the propellant charge to the piston element, and removal of the piston element is reversibly blocked by the operating element, wherein the piston element is movably accommodated in a piston guide such that it is axially displaceable in relation to the hand-held housing of the drive-in device, wherein the starting position of the piston element is set relative to the piston guide in the course extending the piston guide forward in a drive-in direction.

15. The drive-in device according to claim 14, wherein the operating element comprises an annular sleeve, the sleeve encircling the center axis (A).

16. The drive-in device as claimed in claim 15, wherein the sleeve is held in at least one defined position by a catch element.

17. The drive-in device as claimed in claim 14, comprising a locking element blocking the piston element, wherein the locking element can be unlocked only in one of multiple positions of the operating element.

18. The drive-in device as claimed in claim 17, wherein the operating element has a recess, the locking element being movable in radial direction when the locking element is covered by the recess.

19. The drive-in device according to claim 17, wherein the operating element comprises an annular sleeve, the sleeve encircling the center axis (A).

* * * * *